US011239069B2

(12) United States Patent
Maeda et al.

(10) Patent No.: US 11,239,069 B2
(45) Date of Patent: Feb. 1, 2022

(54) MASS SPECTROMETER

(71) Applicant: SHIMADZU CORPORATION, Kyoto (JP)

(72) Inventors: Kazuma Maeda, Kyoto (JP); Daisuke Okumura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/053,128

(22) PCT Filed: May 31, 2018

(86) PCT No.: PCT/JP2018/021010
§ 371 (c)(1),
(2) Date: Nov. 5, 2020

(87) PCT Pub. No.: WO2019/229945
PCT Pub. Date: Dec. 5, 2019

(65) Prior Publication Data

US 2021/0249250 A1 Aug. 12, 2021

(51) Int. Cl.
*H01J 49/42* (2006.01)
*H01J 49/02* (2006.01)
(Continued)

(52) U.S. Cl.
CPC ..... *H01J 49/4215* (2013.01); *H01J 49/022* (2013.01); *H01J 49/025* (2013.01); *H01J 49/063* (2013.01); *H01J 49/401* (2013.01)

(58) Field of Classification Search
CPC .... H01J 49/4215; H01J 49/022; H01J 49/025; H01J 49/063; H01J 49/401
See application file for complete search history.

(56) References Cited

U.S. PATENT DOCUMENTS

2016/0118235 A1 4/2016 Fujita

FOREIGN PATENT DOCUMENTS

WO 2014/181396 A1 11/2014

OTHER PUBLICATIONS

International Search Report of PCT/JP2018/021010 dated Aug. 21, 2018 [PCT/ISA/210].

(Continued)

*Primary Examiner* — Nicole M Ippolito
*Assistant Examiner* — Hanway Chang
(74) *Attorney, Agent, or Firm* — Sughrue Mion, PLLC

(57) ABSTRACT

When a Q-TOF type mass spectrometer is operated in an $MS^1$ mode, a controller (40), at the time of measurement, controls voltage generators (31 to 33) such that only a V voltage (radio-frequency voltage for mass separation) and a direct-current bias voltage are applied to main rod electrodes of a quadrupole mass filter (12) without application of a U voltage (direct-current voltage for mass separation). During a measurement preparation period between a plurality of measurements to obtain one mass spectrum, the controller (40) controls a U voltage generator (31) so as to apply the U voltage to the main rod electrodes of the quadrupole mass filter (12). Accordingly, a direct-current electric field is formed between adjacent main rod electrodes around an ion optical axis (C) due to a potential difference, and electric charges accumulated in rod holders (122) holding the main rod electrodes are rapidly removed by an effect of this electric field. As a result, it is possible to eliminate a charge-up that has not been eliminated by a conventional method in which a polarity of a direct-current bias voltage applied to the rod electrodes is merely reversed.

4 Claims, 3 Drawing Sheets

(51) Int. Cl.
*H01J 49/06* (2006.01)
*H01J 49/40* (2006.01)

(56) References Cited

OTHER PUBLICATIONS

Written Opinion of PCT/JP2018/021010 dated Aug. 21, 2018 [PCT/ISA/237].

MASS SPECTROMETER

CROSS REFERENCE TO RELATED APPLICATIONS

This application is a National Stage of International Application No. PCT/JP2018/021010, filed May 31, 2018.

TECHNICAL FIELD

The present invention relates to a mass spectrometer, and more particularly to a mass spectrometer including an ion transport optical element such as a multipole ion guide.

BACKGROUND ART

Generally, a mass spectrometer generates ions derived from a sample component in an ion source, and transports the generated ions to a mass separator by an ion transport optical element called an ion lens or an ion guide. Then, the mass separator separates the ions according to a mass-to-charge ratio m/z and a detector detects the ions. As the mass separator, a quadrupole mass filter, a time-of-flight type mass separator, or the like is often used.

One of problems that occurs in such a mass spectrometer is a charge-up phenomenon (charging).

For example, in a mass spectrometer using an atmospheric pressure ion source such as an electrospray ion source, sample droplets in a state where a solvent is not sufficiently vaporized by the ion source are sent to a rear stage and adhere to and deposit on a surface of the ion transport optical element. When dirt or foreign matter adheres to the surface of the ion transport optical element to form an insulating layer, a charge-up easily occurs when ions (charged particles) collide with a portion where the insulating layer is formed. Further, an ion transport optical element such as a quadrupole mass filter or an ion guide is fixed at a predetermined position in a space by being held by a structure made of an insulating material such as ceramic. When ions come into contact with such an insulating structure, a charge-up also occurs.

When the charge-up becomes severe, an electric field formed in an ion passage space by a voltage applied to the ion transport optical element is disturbed, which makes it difficult for the ions to pass or to properly converge or accelerate. Accordingly, the amount of ions that eventually reaches the detector decreases. As a result, detection sensitivity of the ions decreases.

Patent Literature 1 discloses one method for eliminating or reducing the above-mentioned charge-up. Generally, in a quadrupole mass filter, a pre-rod electrode is arranged immediately before a main rod electrode that forms a quadrupole electric field (electric field in which a radio-frequency electric field and a direct-current electric field are superimposed) for separating ions according to the mass-to-charge ratio so as to reduce turbulence of an edge electric field of the quadrupole electric field. In the mass spectrometer described in Patent Literature 1, in order to reduce a charge-up on a surface of the pre-rod electrode and an insulating structure holding the pre-rod electrode, during a waiting time between one measurement and the next measurement, the polarity of the direct-current bias voltage applied to the pre-rod electrode is reversed for a short time from the polarity of the direct-current bias voltage at a time of measurement before and after the waiting time. When the polarity of the direct-current bias voltage is temporarily reversed in this way, the polarity becomes the same as the polarity of the electric charges that constitute the charge-up. Therefore, the electric charges accumulated on the surface of the insulating structure are released and the charge-up is eliminated.

CITATION LIST

Patent Literature

Patent Literature 1: WO 2014/181396 A1

SUMMARY OF INVENTION

Technical Problem

However, according to a study based on the experiment of the present inventor, although the method described in Patent Literature 1 is effective in improving detection sensitivity in many cases and is presumed to be effective in reducing the charge-up, in some cases, the effect may not always be sufficient.

The present invention has been made to solve such a problem, and an object of the present invention is to provide a mass spectrometer that can more reliably eliminate or reduce the charge-up even when the charge-up cannot be sufficiently eliminated by the above-mentioned conventional method, thereby avoiding a decrease in the detection sensitivity and the like.

Solution to Problem

The present invention, which has been made to solve the above-mentioned problem, is a mass spectrometer having one or more ion transport optical elements each of which includes a plurality of electrodes arranged so as to surround an ion optical axis between an ion source that generates ions derived from a sample component and a detector which detects ions separated according to a mass-to-charge ratio, and transports ions while converging the ions by an effect of a radio-frequency electric field formed by the plurality of electrodes, the mass spectrometer including:

a) a direct-current voltage generator configured to apply direct-current voltages of different polarities to electrodes adjacent to each other around the ion optical axis included in at least one of the one or more ion transport optical elements; and b) a controller configured to control an operation of the direct-current voltage generator so as to apply a predetermined direct-current voltage to each of the plurality of electrodes included in the at least one of the one or more ion transport optical elements from the direct-current voltage generator during a measurement preparation period during which no measurement is substantially performed between one measurement and a next measurement, and stop application of the direct-current voltage during a measurement period during which a measurement is performed.

The "ion transport optical element" described here typically refers to an ion guide including a plurality of rod electrodes. Further, a quadrupole mass filter generally performs an ion separation operation according to a mass-to-charge ratio. However, when applying only a radio-frequency voltage or a radio-frequency voltage and a direct-current bias voltage without applying a direct-current voltage for mass separation to the rod electrodes constituting the quadrupole mass filter, the quadrupole mass filter operates substantially in the same manner as the ion guide. Therefore, the quadrupole mass filter in a driving state in which the mass separation operation is not performed corresponds to the "ion transport optical element" described here.

For example, in a triple quadrupole mass spectrometer having front and rear quadrupole mass filters with a collision cell in between, in some cases, an $MS^1$ mass spectrometry mode is executed to let ions pass free through the front quadrupole mass filter and mass-separate the ions in the rear quadrupole mass filter, and, in other cases, another $MS^1$ mode is executed to mass-separate the ions in the front quadrupole mass filter and let the ions pass free through the rear quadrupole mass filter. In such cases, the front quadrupole mass filter or the rear quadrupole mass filter is substantially the above-mentioned "ion transport optical element".

In a quadrupole-time-of-flight type (Q-TOF type) mass spectrometer having a quadrupole mass filter in a front stage and a time-of-flight type mass separator in a rear stage with a collision cell in between, in some cases, an $MS^1$ mode is executed to let ions pass free through the front stage quadrupole mass filter and mass-separate the ions in the rear stage time-of-flight mass separator. In such a case, the front stage quadrupole mass filter is substantially the above-mentioned "ion transport optical element".

In the case of the method described in Patent Literature 1, the polarity of the direct-current bias voltage applied to the rod electrodes or the like constituting the ion guide for eliminating the charge-up is temporarily reversed, but at this time, the polarity of the direct-current potential of the rod electrodes adjacent to each other around the ion optical axis is the same. Therefore, there is no potential difference between the rod electrodes adjacent to each other around the ion optical axis, and no potential gradient is generated. Therefore, for example, in an annular rod holder holding a plurality of rod electrodes, among electric charges accumulated in a portion between the adjacent rod electrodes, it is presumed that although the electric charges existing very close to the rod electrodes move in a direction away from the rod electrodes, the electric charges remain without being removed from the portion between the adjacent rod electrodes.

On the other hand, in the present invention, the controller controls the direct-current voltage generator, and during the measurement preparation period during which no measurement is substantially performed, applies direct-current voltages of different polarities to electrodes adjacent to each other around the ion optical axis among a plurality of electrodes included in at least one of one or more ion transport optical elements. Therefore, a potential gradient is generated between the rod electrodes adjacent to each other around the ion optical axis, and as described above, the electric charges accumulated in the portion between the adjacent rod electrodes in the annular rod holder is smoothly moved by the above-mentioned potential gradient, and properly removed from the portion between adjacent rod electrodes. As a result, the charge-up, which has not been sufficiently eliminated by the conventional method, can be more reliably eliminated.

In one embodiment of the present invention, in the above-mentioned $MS^1$ mode, the measurement is repeated a predetermined number of times, and data obtained by each of the predetermined number of measurements are accumulated to create a mass spectrum in a predetermined mass-to-charge ratio range.

The above-mentioned controller is configured to control an operation of the direct-current voltage generator so as to apply a predetermined direct-current voltage to each of a plurality of electrodes included in a quadrupole mass filter from the direct-current voltage generator during a measurement preparation period between the predetermined number of measurements for obtaining one mass spectrum and the predetermined number of measurements for obtaining another mass spectrum, and stop the application of the direct-current voltage during a measurement period.

According to this configuration, the direct-current voltage application operation for eliminating the charge-up described above is performed every predetermined number of measurements, so that the measurement is always performed in a good state in which the charge-up is eliminated. As a result, it is possible to acquire a mass spectrum with high accuracy and sensitivity.

Advantageous Effects of Invention

According to the present invention, even when a charge-up cannot be sufficiently eliminated by the above-mentioned conventional method, the charge-up can be more reliably eliminated or reduced. As a result, favorable mass spectrometry results can be obtained while avoiding a decrease in detection sensitivity.

DESCRIPTION OF EMBODIMENTS

A Q-TOF type mass spectrometer, which is an embodiment of the present invention, will be described with reference to the accompanying drawings.

Figure 1:
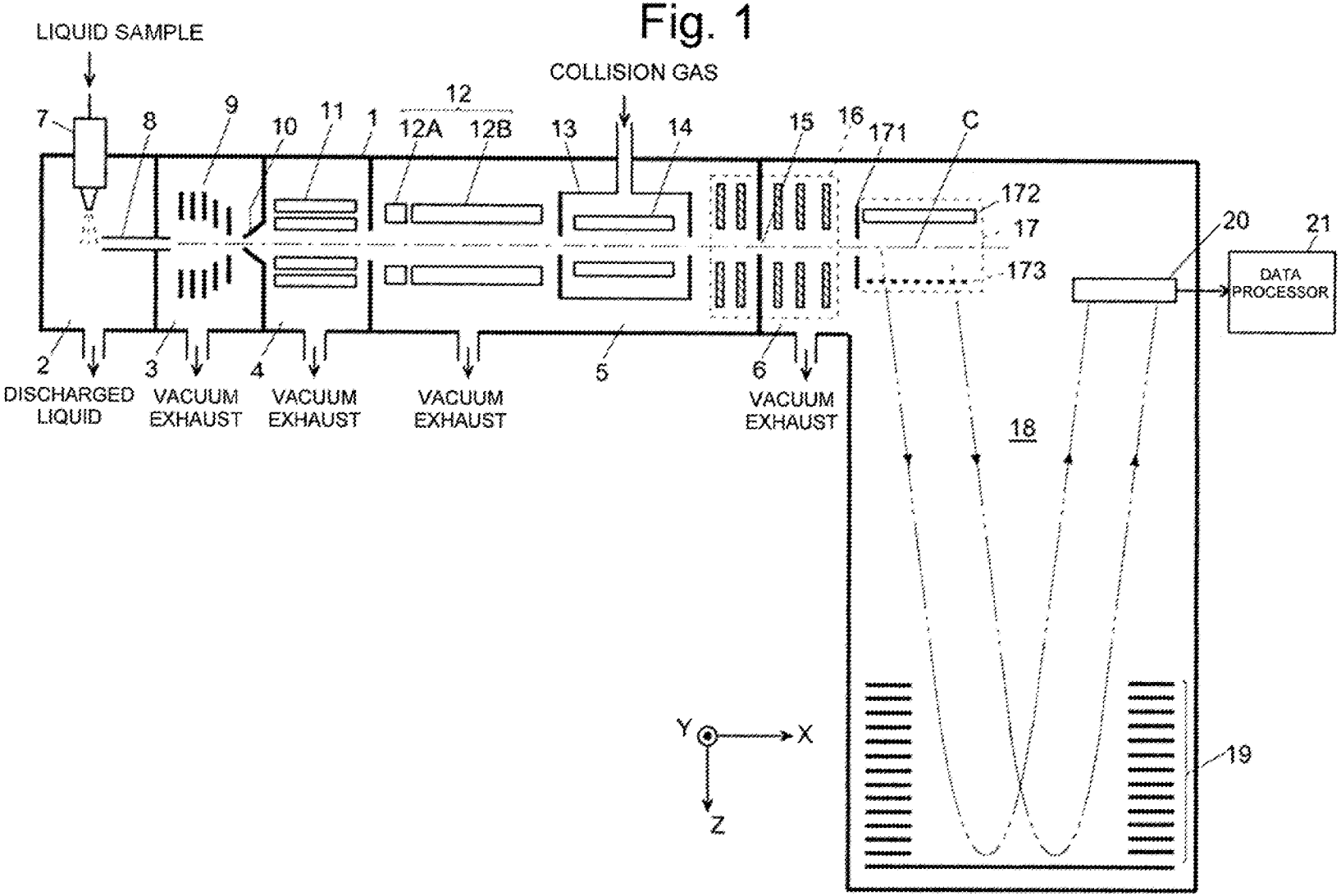
FIG. 1 is a schematic configuration diagram of a Q-TOF type mass spectrometer, which is an embodiment of the present invention.
Figure 2:
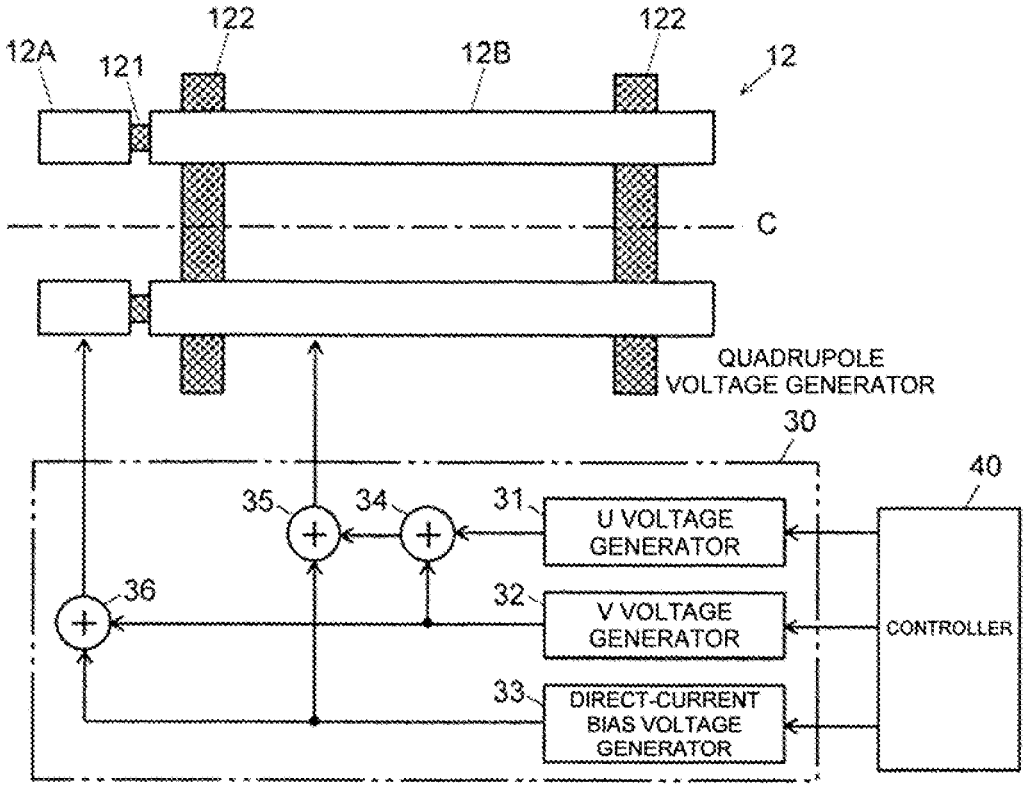
FIG. 2 is a schematic configuration diagram of a quadrupole mass filter and its control system in the Q-TOF type mass spectrometer of the present embodiment.
Figure 3:
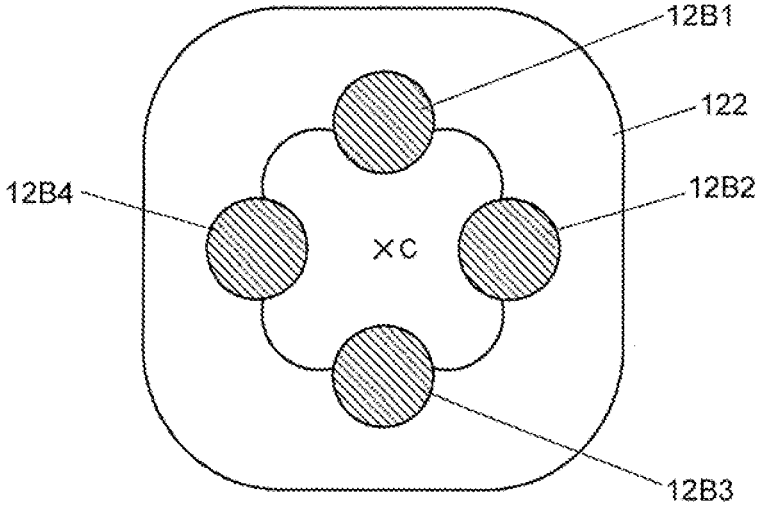
FIG. 3 is a cross-sectional view of a quadrupole mass filter in a plane orthogonal to an ion optical axis.

FIG. 1 is a schematic configuration diagram of the Q-TOF type mass spectrometer of the present embodiment, FIG. 2 is a schematic configuration diagram of a quadrupole mass filter and its control system in FIG. 1, and FIG. 3 is a cross-sectional view of the quadrupole mass filter in a plane orthogonal to an ion optical axis.

The Q-TOF type mass spectrometer of the present embodiment has a configuration of a multi-stage differential evacuation system, and a chamber 1 is provided with an ionization chamber 2 having a substantially atmospheric pressure atmosphere and a second analysis chamber 6 with a highest degree of vacuum, a first intermediate vacuum chamber 3, a second intermediate vacuum chamber 4, and a first analysis chamber 5 in which the degree of vacuum increases in order from the ionization chamber 2 to the second analysis chamber 6.

The ionization chamber 2 is provided with an electrospray ionization (ESI) spray 7 for performing ionization by an ESI method, and when a liquid sample containing a target compound is supplied to the ESI spray 7, charged droplets are nebulized from a tip of the spray 7, ions derived from the target compound are generated in a process in which the charged droplets are divided and a solvent is evaporated. The ionization method is not limited to this, and other ionization methods such as an atmospheric pressure chemical ionization (APCI) method and an atmospheric pressure photoionization (APPI) method may be used.

Various ions generated in the ionization chamber 2 are sent to the first intermediate vacuum chamber 3 through a heating capillary 8, converged by an array type ion guide 9 arranged in the first intermediate vacuum chamber 3, and sent to the second intermediate vacuum chamber 4 through a skimmer 10. Further, the ions are converged by a multipole ion guide 11 arranged in the second intermediate vacuum chamber 4 and sent to the first analysis chamber 5. In the first analysis chamber 5, a quadrupole mass filter 12 and a collision cell 13 in which a multipole type ion guide 14 is arranged are provided.

Various ions derived from a sample are introduced into the quadrupole mass filter 12, and during an MS/MS analysis, ions having a specific mass-to-charge ratio according to a voltage applied to the quadrupole mass filter 12 pass through the quadrupole mass filter 12. These ions are introduced into the collision cell 13 as precursor ions, and the precursor ions are dissociated by contact with collision gas supplied into the collision cell 13 to generate various product ions. On the other hand, during normal mass spectrometry ($MS^1$ analysis) without ion dissociation, the ions derived from a sample component pass through the quadrupole mass filter 12 almost as they are, are introduced into the collision cell 13, and supplied into the collision cell 13, and contact with the collision gas reduces (that is, cools) energy.

The ions derived from the sample component (product ions generated by dissociation or undissociated ions) are transported while being converged in the collision cell 13. Then, the ions discharged from the collision cell 13 are introduced into the second analysis chamber 6 through an ion passage port 15 while being guided by an ion transport optical system 16. In the second analysis chamber 6, an orthogonal accelerator 17 which is an ion ejection unit, a flight space 18 in which a reflector 19 is arranged, and an ion detector 20 are provided. The ions introduced into the orthogonal accelerator 17 in an X-axis direction along an ion optical axis C are ejected from the orthogonal accelerator 17 by being accelerated in a Z-axis direction in a pulsed manner at a predetermined timing. As shown by alternate long and two short dashes lines in FIG. 1, the ejected ions fly freely in the flight space 18, then are turned back by a reflected electric field formed by the reflector 19, fly freely in the flight space 18 again, and reach the ion detector 20.

A flight time from departure of the ions from the orthogonal accelerator 17 to arrival at the ion detector 20 depends on the mass-to-charge ratio of the ions. The ion detector 20 outputs an ion-intensity signal according to the amount of incident ions moment by moment. A data processor 21 receives the ion-intensity signal from the ion detector 20 and accumulates flight time spectrum data obtained by digitizing the signal, and then integrates the flight time spectrum data obtained by each of a plurality of measurements to create a flight time spectrum and converts the flight time into a mass-to-charge ratio to create a mass spectrum. The "measurement" described here refers to a cycle of acquiring an ion-intensity signal over a predetermined flight time range corresponding to one ion ejection.

As shown in FIG. 2, the quadrupole mass filter 12 includes a main quadrupole mass filter section 12B including four main rod electrodes (reference numerals 12B1 to 12B4 in FIG. 3) that substantially contribute to ion separation, and a pre-quadrupole mass filter section 12A including four short pre-rod electrodes located in front of the four main rod electrodes, respectively. The four main rod electrodes 12B1 to 12B4 are connected to the pre-rod electrodes in front of the four main rod electrodes 12B1 to 12B4, respectively, by a connecting rod 121 made of ceramic (or other non-conductive material). Further, the four main rod electrodes 12B1 to 12B4 are held by two annular rod holders 122 made of ceramic (or other non-conductive material). That is, the rod holders 122 hold the four main rod electrodes 12B1 to 12B4 at predetermined positions around the ion optical axis C with high accuracy, and the connecting rod 121 holds the pre-rod electrodes in front of the main rod electrodes 12B1 to 12B4 with high accuracy.

A quadrupole voltage generator 30 applies a predetermined voltage to each of the main rod electrodes 12B1 to 12B4 and pre-rod electrodes included in the quadrupole mass filter 12. The quadrupole voltage generator 30 includes a U voltage generator 31, a V voltage generator 32, a direct-current bias voltage generator 33, and first to third voltage addition units 34 to 36. A controller 40 controls operations of the U voltage generator 31, the V voltage generator 32, and the direct-current bias voltage generator 33.

A U voltage is a direct-current voltage for ion separation according to the mass-to-charge ratio, and the U voltage generator 31 generates a positive/negative direct-current voltage (±U), which is a predetermined voltage value, based on an instruction of the controller 40. A V voltage is a radio-frequency voltage for ion separation according to the mass-to-charge ratio, and the V voltage generator 32 generates radio-frequency voltages (±V cos ωt) of mutually reverse polarities, which are predetermined amplitude values, based on the instruction of the controller 40. The direct-current bias voltage generator 33 generates a predetermined direct-current bias voltage (VB) based on the instruction of the controller 40. Although this direct-current bias voltage does not contribute to the separation of ions, the ions can be accelerated or decelerated through utilization of a direct-current voltage difference from the ion guide 11 in a front stage.

When ions having a predetermined mass-to-charge ratio is allowed to pass through the quadrupole mass filter 12, the U voltage generator 31, the V voltage generator 32, and the direct-current bias voltage generator 33 each generate a predetermined voltage. The generated voltage added (superimposed) by the voltage addition units 34 and 35, which is a voltage+(U+V cos ωt)+Vb or −(U+V cos ωt+Vb, is applied to the main rod electrodes 12B1 to 12B. On the other hand, a voltage to which the U voltage is not added, which is a voltage+V cos ωt+Vb or −V cos ωt+Vb, is applied to the pre-rod electrode. The voltage value of U voltage and the amplitude value of V voltage are values according to the mass-to-charge ratio of the selected ions.

A radio-frequency electric field formed by the radio-frequency voltage applied to the pre-rod electrode constituting the pre-quadrupole mass filter section 12A mainly corrects an edge electric field due to the main rod electrodes 12B1 to 12B4, and helps favorable introduction of ions into a space surrounded by the main rod electrodes 12B1 to 12B4. The introduced ions vibrate due to a quadrupole electric field when passing through the space surrounded by the main rod electrodes 12B1 to 12B4, and only ions having a predetermined mass-to-charge ratio stably pass through the space and other ions are diverged on the way. In this way, the ions selected according to the mass-to-charge ratio pass through the quadrupole mass filter 12 and are sent to the rear stage.

As a matter of course, a predetermined voltage is applied to each component other than the quadrupole mass filter 12 such as the ESI spray 7 and the ion guide 9 in FIG. 1.

However, since the component to which the predetermined voltage is applied is not important in the present invention, the description is omitted.

In the Q-TOF type mass spectrometer of the present embodiment, it is possible to perform an MS/MS analysis by dissociating the ions in the collision cell 13, but as described above, it is also possible to perform an $MS^1$ analysis in which the ions are not dissociated in the collision cell 13. In the Q-TOF type mass spectrometer of the present embodiment, characteristic control is performed when a normal $MS^1$ analysis is performed.

Figure 4:
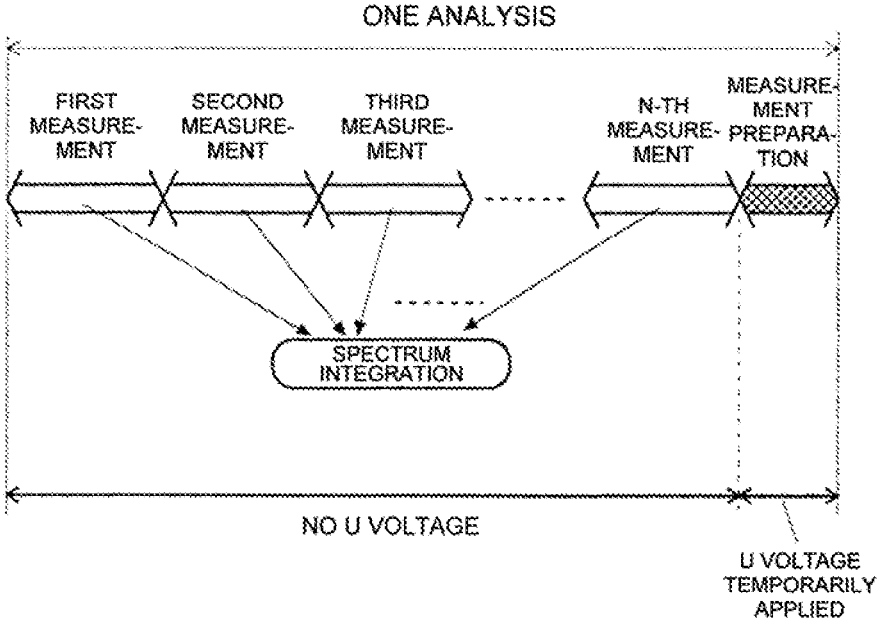
FIG. 4 is a timing diagram in one analysis cycle.

Hereinafter, the characteristic control operation will be described with reference to FIG. 4 in addition to FIGS. 1 to 3. FIG. 4 is a timing diagram during one analysis cycle in an $MS^1$ mode.

In the $MS^1$ mode, as shown in FIG. 4, n measurements (a plurality n of measurements) are repeated during one analysis cycle, and the flight time spectrum data obtained by each of the n measurements is integrated. The mass spectrum is obtained from the flight time spectrum obtained by the integration of the flight time spectrum data. In the $MS^1$ mode, since ion separation is not performed by the quadrupole mass filter 12, no U voltage is applied to the main rod electrodes 12B1 to 12B4, and the V voltage is set to such a voltage that the ions in a predetermined mass-to-charge ratio range can be transported while being converged. Therefore, during the measurement in the $MS^1$ analysis mode, a voltage+V cos ωt+Vb or −V cos ωt+Vb is applied to the main rod electrodes 12B1 to 12B. If the measurement conditions in n measurements during one analysis cycle, specifically the mass-to-charge ratio range of ions passing through the quadrupole mass filter 12 and ion guides 9, 11 and 14, are the same, a mass spectrum with high sensitivity can be obtained.

In addition, the mass-to-charge ratio range of ions that can pass through the ion guides 9, 11, 14 or the quadrupole mass filter 12 driven so as to allow passing of the ions is usually limited. In particular, the mass-to-charge ratio range becomes relatively narrow when passing of ions with a low mass-to-charge ratio is allowed. Therefore, in n measurements during one analysis cycle, the mass-to-charge ratio range of the ions that pass through the quadrupole mass filter 12 and the ion guides 9, 11 and 14 is changed so as to obtain a mass spectrum over a wider mass-to-charge ratio range.

As described above, no U voltage is applied to the four main rod electrodes 12B1 to 12B4 of the quadrupole mass filter 12 during n measurements during one analysis cycle in the $MS^1$ analysis mode. On the other hand, a measurement preparation period of a predetermined time is provided between the n measurements in one analysis cycle and the n measurements in the next analysis cycle. Then, the controller 40 operates the U voltage generator 31 only during the predetermined time during the measurement preparation period, and applies a U voltage to each of the four main rod electrodes 12B1 to 12B4. What is important is to apply direct-current voltages of different polarities to the main rod electrodes 12B1 to 12B4 adjacent to each other around the ion optical axis C. Therefore, the voltage value of the U voltage applied at this time may correspond to any of the mass-to-charge ratios of the ions passing through the main quadrupole mass filter section 12B.

When U voltages of different polarities are applied to the adjacent main rod electrodes 12B1 to 12B4 around the ion optical axis C, a large direct-current electric field is formed between two adjacent main rod electrodes, for example, the main rod electrodes 12B1 and 12B4, or the main rod electrodes 12B1 and 12B2 in FIG. 3. Electric charges accumulated in the portion between the adjacent main rod electrodes 12B1 to 12B4 in the rod holders 122 rapidly move in a direction of one of the main rod electrode 12B1 to 12B4 by an effect of this electric field and disappear. As a result, a charge-up of the rod holders 122 is eliminated. During this charge-up elimination operation, it is preferable to stop applying the V voltage to the main rod electrodes 12B1 to 12B4 so as not to hinder a smooth movement of the accumulated electric charges.

For the time during which the U voltages are applied during the measurement preparation period, it is desirable to consider and decide in advance time required for the potentials of the main rod electrodes 12B1 to 12B4 to settle to the potentials in the next measurement after the application of the U voltages is stopped. Specifically, for example, when the measurement preparation period is 1 msec, the U voltages are applied to the four main rod electrodes 12B1 to 12B4 only during the first 200 μsec of the measurement preparation period, and when 200 μsec elapses, the voltages may be switched to voltages to be applied to the main rod electrodes 12B1 to 12B4 in the next measurement.

In the above embodiment, the charge-up elimination operation is performed by applying the U voltage once in one analysis cycle, but it is not always necessary to perform the charge-up elimination operation in each analysis cycle. For example, the charge-up elimination operation may be performed in every predetermined number of analysis cycles.

Further, in the above embodiment, the electric charges accumulated in the rod holders holding the rod electrodes of the quadrupole mass filter in the Q-TOF type mass spectrometer are removed. The present invention is also effective in removing electric charges accumulated in a structure such as rod holders holding the rod electrodes constituting the ion guides that converge and transport ions by an effect of the radio-frequency electric field. However, since such ion guides generally do not have a circuit corresponding to the above-mentioned U voltage generator 31, it is necessary to specially add such a circuit.

Further, it is clear that the present invention can be applied not only to the Q-TOF type mass spectrometer but also to a triple quadrupole mass spectrometer and a single type quadrupole mass spectrometer.

Furthermore, since all of the above embodiments are examples of the present invention, it is clear that points other than those described above are included in the claims of the present application even if they are appropriately modified, added, or corrected within the scope of the present invention.

REFERENCE SIGNS LIST

1 . . . Chamber
2 . . . Ionization Room
3 . . . First Intermediate Vacuum Chamber
4 . . . Second Intermediate Vacuum Chamber
5 . . . First Analysis Room
6 . . . Second Analysis Room
7 . . . ESI Spray
8 . . . Heating Capillary
9 . . . Array Type Ion Guide
10 . . . Skimmer
11 . . . Multipole Ion Guide
12 . . . Quadrupole Mass Filter
12A . . . Pre-Quadrupole Mass Filter Section
12B . . . Main Quadrupole Mass Filter Section
12B1-12B4 . . . Main Rod Electrode
121 . . . Connecting Rod

122 . . . Rod Holder
13 . . . Collision cell
14 . . . Ion Guide
15 . . . Ion Passage Port
16 . . . Ion Transport Optical System
17 . . . Orthogonal Accelerator
18 . . . Flight Space
19 . . . Reflector
20 . . . Ion Detector
21 . . . Data Processor
30 . . . Quadrupole Voltage Generator
31 . . . U Voltage Generator
32 . . . V Voltage Generator
33 . . . Direct-Current Bias Voltage Generator
34 . . . Voltage Addition Unit
40 . . . Controller
C . . . Ion Optical Axis

The invention claimed is:

1. A mass spectrometer having one or more ion transport optical elements each of which includes a plurality of electrodes arranged so as to surround an ion optical axis between an ion source that generates ions derived from a sample component and a detector which detects ions separated according to a mass-to-charge ratio, and transports ions while converging the ions by an effect of a radio-frequency electric field formed by the plurality of electrodes, the mass spectrometer comprising:

a) a direct-current voltage generator configured to apply direct-current voltages of different polarities to electrodes adjacent to each other around the ion optical axis included in at least one of the one or more ion transport optical elements; and b) a controller configured to control an operation of the direct-current voltage generator so as to apply a predetermined direct-current voltage to each of the plurality of electrodes included in the at least one of the one or more ion transport optical elements from the direct-current voltage generator during a measurement preparation period during which no measurement is substantially performed between one measurement and a next measurement, and stop application of the direct-current voltage during a measurement period during which a measurement is performed.

2. The mass spectrometer according to claim 1, wherein the one or more ion transport optical elements include a quadrupole mass filter in a driving state in which a mass separation operation is not performed, and the direct-current voltage generator applies a direct-current voltage for ion separation to a plurality of rod electrodes included in the quadrupole mass filter.

3. The mass spectrometer according to claim 2, wherein the quadrupole mass filter is provided in front of a collision cell which dissociates ions, and a time-to-flight type mass separator which separates ions according to a mass-to-charge ratio is provided between the collision cell and the detector, and in a normal mass spectrometry mode in which the time-to-flight type mass spectrometer in a rear stage separates ions while the quadrupole mass filter does not separate ions, the controller is configured to control an operation of the direct-current voltage generator so as to apply a predetermined direct-current voltage to each of the plurality of electrodes included in the quadrupole mass filter during a period during which no measurement is substantially performed, and stop application of the direct-current voltage during a measurement period.

4. The mass spectrometer according to claim 3, wherein in the normal mass spectrometry mode, a measurement is repeated a predetermined number of times, and data obtained by each of the predetermined number of measurements are accumulated to create a mass spectrum in a predetermined mass-to-charge ratio range, and the controller is configured to control an operation of the direct-current voltage generator so as to apply a predetermined direct-current voltage to each of the plurality of electrodes included in the quadrupole mass filter from the direct-current voltage generator during the measurement preparation period between the predetermined number of measurements for obtaining one mass spectrum and the predetermined number of measurements for obtaining another mass spectrums, and stop application of the direct-current voltage during a measurement period.

* * * * *